US005513617A

United States Patent [19]

Bass

[11] Patent Number: 5,513,617

[45] Date of Patent: May 7, 1996

[54] BREAKERLESS IGNITION SYSTEM FOR INTERNAL COMBUSTION AIRCRAFT ENGINES

[76] Inventor: Charles D. Bass, 3100 Sander Rd., Davenport, Fla. 33837

[21] Appl. No.: 351,960

[22] Filed: Dec. 8, 1994

[51] Int. Cl.[6] ..... F02P 3/06

[52] U.S. Cl. ..... 123/595; 123/424; 123/617

[58] Field of Search ..... 123/424, 595, 123/617

[56] References Cited

U.S. PATENT DOCUMENTS

| | | | |
|---|---|---|---|
| 3,765,390 | 10/1973 | Loudon et al. | 123/699 |
| 3,906,920 | 9/1975 | Hemphill | 123/595 |
| 4,138,976 | 2/1979 | Crall | 123/424 |
| 4,235,213 | 11/1980 | Jellissen | 123/617 |

OTHER PUBLICATIONS

Article entitled "Magnetos: What Are They" from Light Plane Maintenance of Mar. 1992.

Article entitled "Breaker Point Pointers" from Light Plane Maintenance of Mar. 1992.

*Primary Examiner*—Noah P. Kamen

*Attorney, Agent, or Firm*—Dennison, Meserole, Pollack & Scheiner

[57] ABSTRACT

A breakerless ignition system for internal combustion aircraft engines which includes a pair of separately activated Hall effect and amplifier combinations for controlling the timing and the delivery of electrical energy to the spark plugs of the engine in a predetermined sequence.

5 Claims, 4 Drawing Sheets

BREAKERLESS IGNITION SYSTEM FOR INTERNAL COMBUSTION AIRCRAFT ENGINES

This invention relates to breakerless ignition systems for aircraft internal combustion engines and more particularly to the direct replacement of existing engine ignition systems.

BACKGROUND OF THE INVENTION

Historically, aircraft internal combustion engines have utilized conventional magnetos to provide the ignition spark needed to ignite the combustible mixture within the combustion chamber of the engine. Magnetos have usually been provided in pairs in order to satisfy the desire for redundancy in the ignition system such that in the event of the failure of one magneto, the engine will continue to run, albeit at somewhat reduced efficiency on the remaining magneto. The magnetos are usually mounted on an accessory case positioned at or near the rear of the engine away from the propeller and are secured thereto on appropriate mounting pads which accommodate suitable fasteners to adjustably secure the magneto in a predetermined position on the pad. The magneto is driven by gears contained within the accessory case usually associated with the crankshaft and/or cam shaft and thus, the magneto is driven to provide ignition spark at the appropriate time on the compression stroke of each cylinder.

The magneto usually includes an appropriate coil and condenser defining a tank circuit and houses the coil within the magneto body together with the appropriate mechanical breaker system for distributing the spark to the appropriate cylinder in the proper time sequence.

It is further well known in the field of aircraft engine ignition systems that some means must be provided in order to retard the spark during the starting phases of engine operation and to automatically advance the spark once the engine has started to run. This change in spark timing is normally achieved by the use of an impulse coupler which is positioned on the magneto drive shaft and tends to retard the spark during the starting phase and by means of centrifugal force, advance the spark to a predetermined timing degree once the engine is running under its own power and not relying on the starter motor to provide rotational force.

Thus, it may be seen that conventional magnetos include a combination of features which are necessary to the proper operation of the engine depending upon whether the engine is in the starting phase or the running phase.

In recent years, automotive ignition systems have advanced to a breakerless arrangement wherein electronic devices provide the proper generation, timing and delivery of the electrical energy to the spark plugs without the need for the troublesome breaker points of the conventional ignition system. These devices have not, however, found their way in any significant numbers into the aircraft engine field and it is to this environment that applicant's invention is directed.

SUMMARY OF THE INVENTION

The present invention provides a breakerless ignition system for particular use in association with aircraft internal combustion engines and is a direct replacement for the previously employed magneto system mentioned above. The breakerless ignition system of this invention provides numerous advantages over the former ignition systems including direct replacement mounting on the appropriate accessory pad on the accessory case of the engine, considerably less weight, enhanced clearance between the system and the firewall of the engine compartment, obviates the necessity of breaker points and condenser components and requires considerably less maintenance while providing ease of applicability and considerable reduction in cost.

The advantages enumerated above and others are achieved by the applicant's invention which includes a conventional gearing system interconnecting the ignition device to the engine gear train within the accessory case. For reasons which will become apparent hereinafter, no impulse coupler is required. However, the device does include a conventional gear drive to rotate the distributor finger and deliver a spark impulse to the appropriate spark plug via an ignition harness interconnecting the spark plugs with the ignition device. The invention includes a housing within which the drive gears are positioned and a distribution section within which the electronic components which control the delivery of the spark to the plugs are disposed. A conventional rotor arm is surmounted by a distributor cap which includes a plurality of towers, each of which accommodates a single ignition wire for delivery of the spark to the appropriate spark plug. The electronic modules within the distribution section constitute a pair of "Hall" effect components which are positioned to respond to a rotating magnet and in association with an externally mounted ignition coil to trigger the release of the energy stored in the coil and deliver the same to the appropriate spark plug in predetermined timing sequence.

Two Hall effect devices are employed in this unit and each is activated separately by means of an appropriate key switch, or the like. Thus, the operator may select which of the Hall effect components is active and the unit can be adjusted to one Hall effect component to provide retarded spark for starting the engine and a second Hall effect component to provide running spark when the engine has become self-sustaining. Applicant has found that by the use of his device, the impulse coupler previously used in magnetos to retard the spark is eliminated, less horsepower is required to drive the ignition unit, higher voltages are delivered to the plugs for an enhanced spark and no external components are required other than the conventional ignition coil. It has also been noted that by removing the coil from the interior of the device and positioning it exteriorly thereof, coil cooling and thus enhanced life is achieved. These and other features and advantages will become apparent from the following description of the preferred embodiment, the drawings and the detailed specification and claims which follow hereafter.

BRIEF DESCRIPTION OF THE DRAWINGS

Attention is now directed to the drawings wherein like reference numerals refer to like parts throughout the several views and wherein.

DESCRIPTION OF PREFERRED EMBODIMENTS

Figure 1:
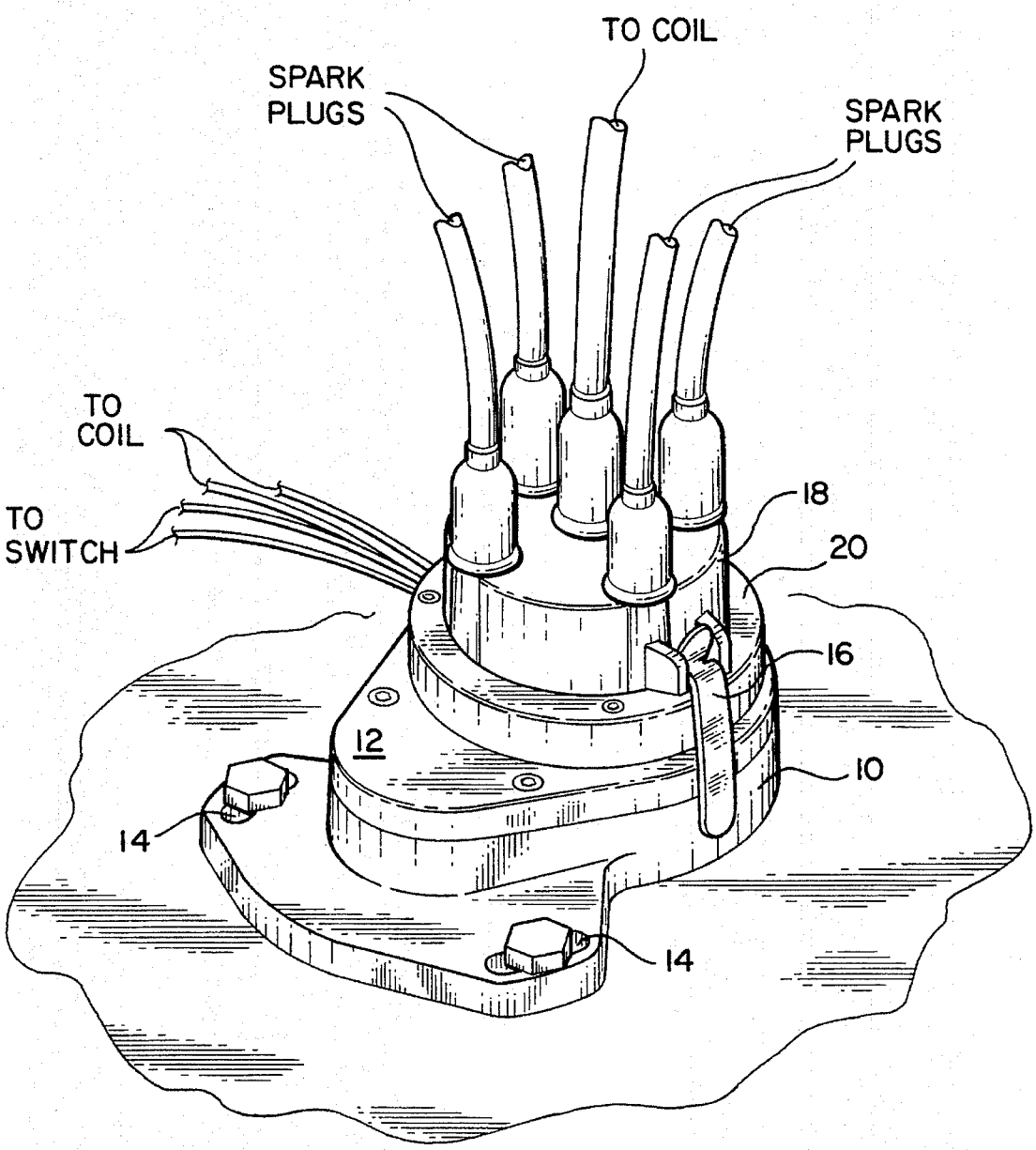
FIG. 1 is a perspective view of applicant's device in its assembled configuration.
Figure 2:
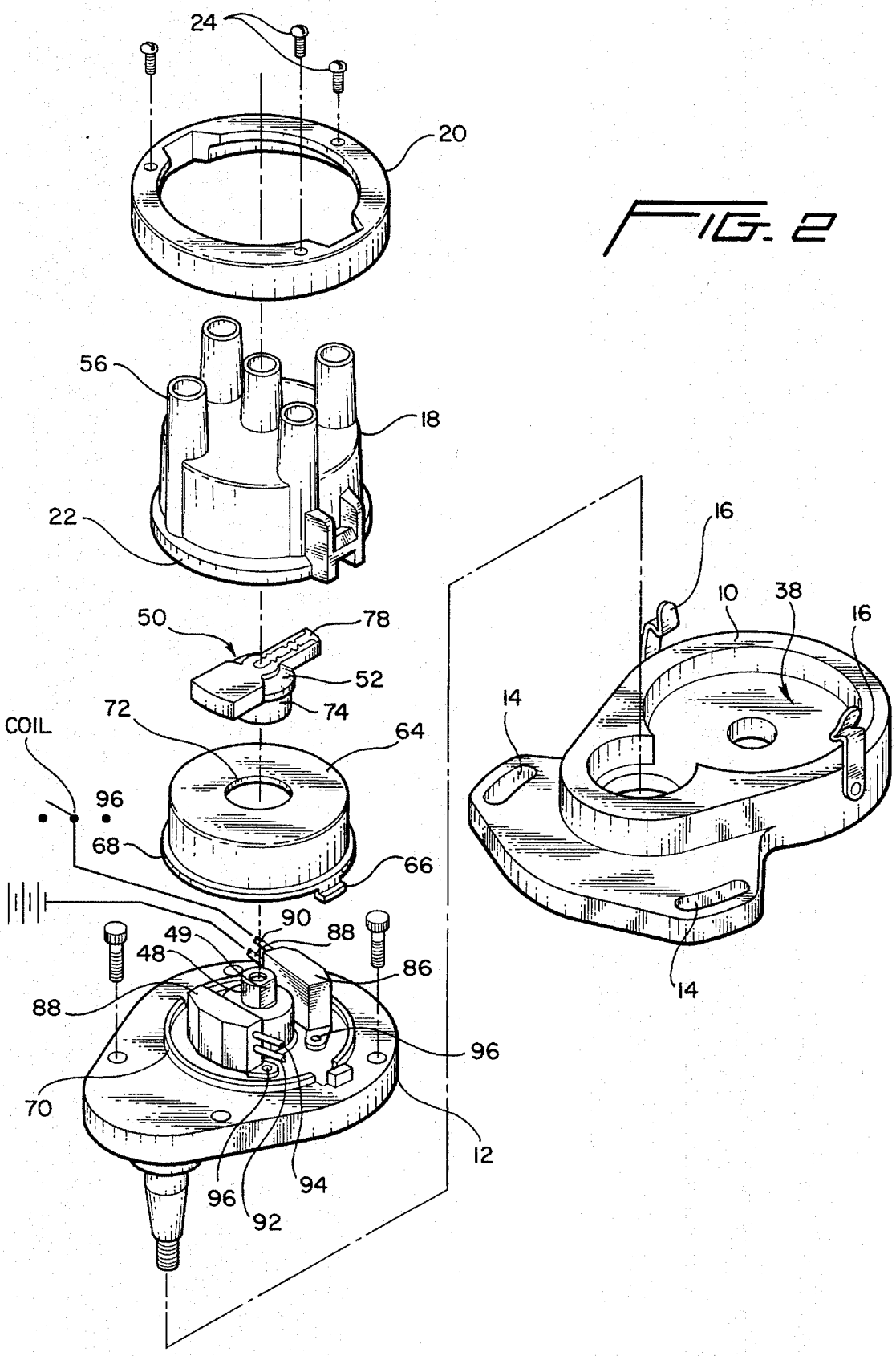
FIG. 2 is an exploded perspective view of applicant's device with the various components separated for identification.

The preferred embodiment of applicant's ignition system is seen in FIG. 2 of the drawings and consists of a two-piece gear case which includes a base member 10 and cover member 12. The base member is configured to accommodate the mounting pad on the accessory case of a conventional internal combustion aircraft engine and includes appropriate openings 14 to receive fastening studs or bolts therethrough to adjustably secure the ignition unit to the engine. In the embodiment illustrated in the right hand portion of FIG. 2, spring clips 16 are utilized to secure the distributor cap 18 to the gear case cover 12 in the manner normally employed in automotive distributor systems. In the left hand portion of FIG. 2, the distributor cap is secured to the gear case cover by means of a retention ring 20 which is configured to overlie the peripheral flange 22 on the distributor cap 18 and is secured to the gear case cover by means of a plurality of threaded fasteners 24.

Figure 3:
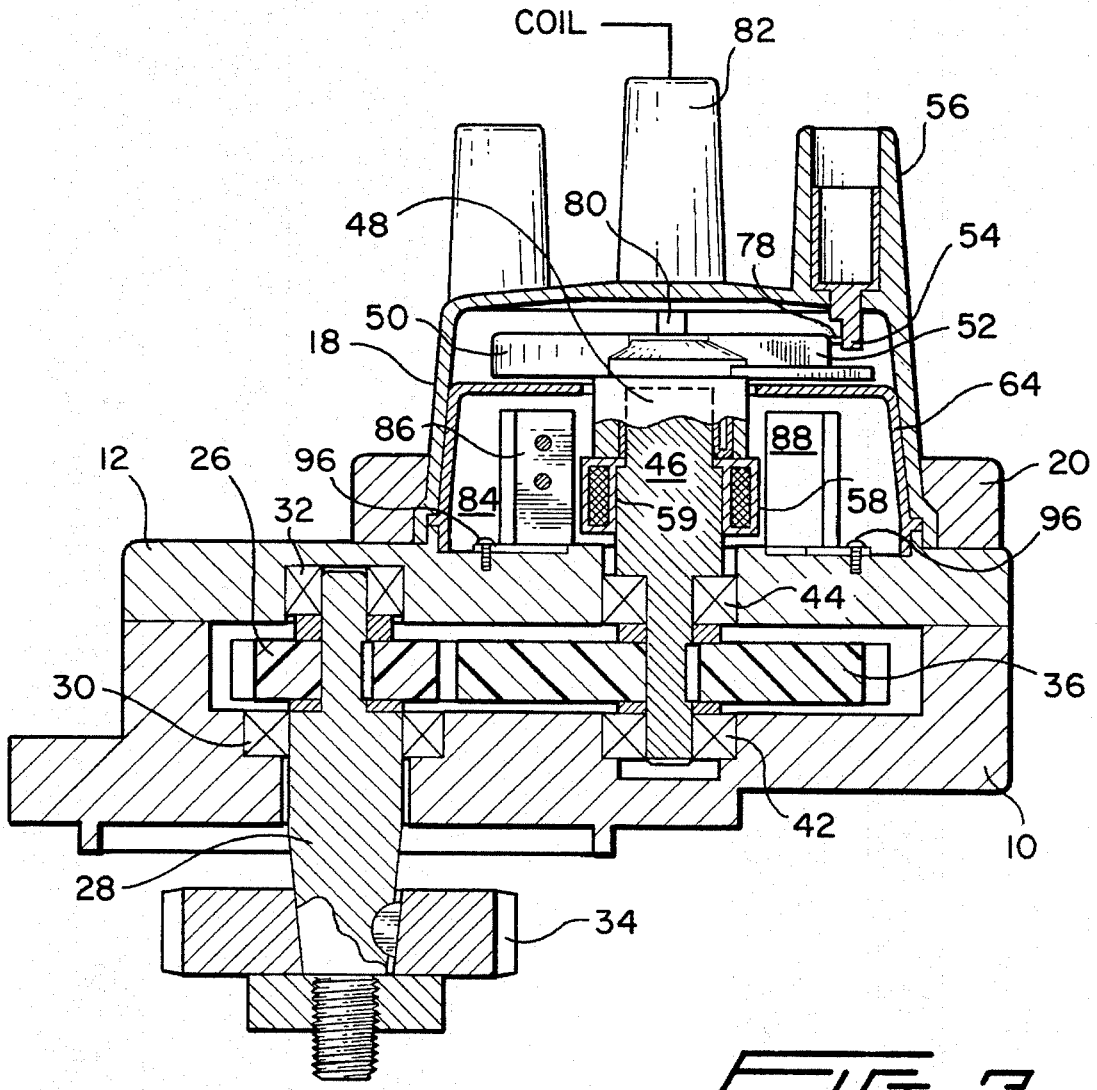
FIG. 3 is a sectioned view in side elevation of the invention illustrated in FIG. 1.

A drive gear 26 is mounted on a drive shaft 28 supported within a bearing 30 in the gear case and a second bearing 32 in the gear case cover 12. The drive shaft 28 extends outwardly through an appropriate opening in the gear case and supports a gear 34 which is in driving engagement with an appropriate engine gear (not shown) within the engine accessory case. The drive gear 26 is drivingly engaged with the rotor gear 36 contained within the larger recess 38 of the gear case 10 while the drive gear 26 is positioned within the smaller recess 40 in the gear case. Rotor gear 36 is supported on bearings 42 and 44 mounted in the gear case and gear case cover, respectively, as well as on the rotor shaft 46 which extends through an appropriate opening in the gear case cover terminating at its upper end, as seen in FIG. 3 of the drawings, in a mounting stub 48 on which the rotor arm 50 is positioned. The rotor arm includes a finger 52 extending laterally therefrom to a position in close proximity to the terminal 54 of an ignition wire tower 56.

Figure 4:
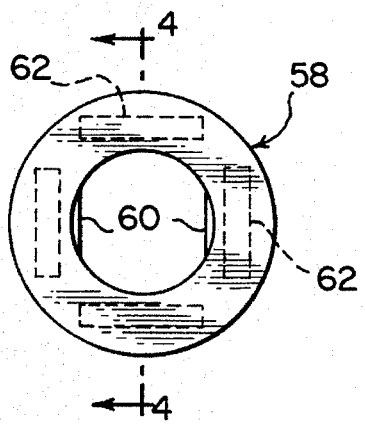
FIG. 4 is a top plan view of one of the components of the system.
Figure 5:
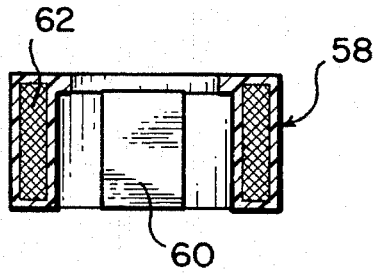
FIG. 5 is a sectional side elevation of the component illustrated in FIG. 4.

A rotor collar 58, shown best in FIGS. 4 and 5 of the drawings, is mounted to encircle the rotor shaft 46 and is keyed thereto by means of cooperating flats on the interior surface of the rotor collar and on the exterior surface of the rotor shaft. The rotor collar provides a support for a plurality of magnets 62 which are positioned adjacent each of the orienting flats 60 for a purpose to be described in greater detail hereinafter. An insulating dust cover 64 overlies a portion of the gear case cover 12 and is provided with a plurality of orienting lugs 66 and a peripheral flange 68 which cooperates with a shoulder 70 on the gear case cover. An opening 72 centrally located in the dust cover 64 is configured to receive a boss 74 on the lower portion of the body of the rotor arm 50 which is drivingly engaged with the stub 48 of the drive shaft 46 by means of cooperating flattened surfaces 49 on the stub shaft and a complementary surface 51 on the interior of the boss 74 on the rotor arm 50. A contact 78 is integrally mounted in the upper surface of the finger 52 and is configured to interconnect a coil contact 80 at the base of the coil tower 82 with the respective spark plug wire contacts 54 as the finger passes in close proximity to each of the terminals 54.

Within a chamber 84 defined by the dust cover and the gear case cover 12 are positioned two Hall effect modules 86 and 88. These modules are mounted adjacent the rotor shaft and in close proximity to the rotor collar containing the magnetic components 62. An air gap is defined between the modules 86 and 88 and the external surface of the rotor collar so that there is no physical contact therebetween.

The Hall effect module 86 constitutes an encapsulated Hall effect device and amplifier which is responsive to the magnetic components 62 contained within the rotor collar 58 and triggers the discharge of the ignition coil 88 when the rotor collar and its magnet achieve a predetermined position with respect to the module 86. Such coil discharge through contact 80 delivers the energy to each of the ignition wire contacts 54 in predetermined sequence depending upon the ignition timing required by the engine. The distributor cap 18 includes an appropriate tower 56 and contact 54 for each of the cylinders which the engine design requires and the ignition wires are positioned within the towers in a predetermined order to accommodate the firing order of the engine. Such a Hall effect module may be purchased "over the counter" of automotive supply houses under the name Pertronix Inc. of Covina, Calif. This unit is commonly employed in automotive distributor systems.

Figure 6:
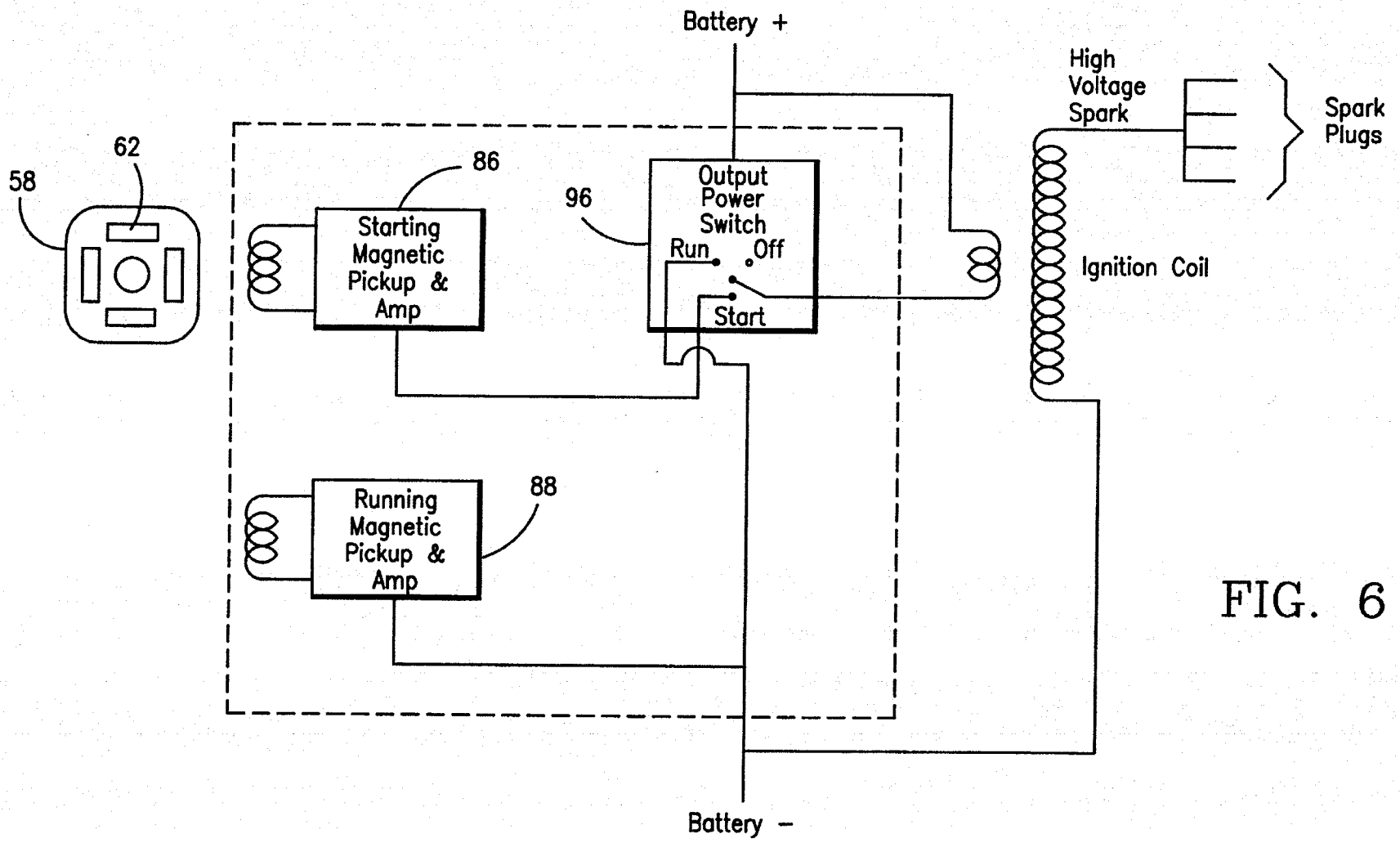
FIG. 6 is a schematic circuit diagram of a typical ignition device of the invention.

Conductors 88 and 90 extend from the Hall effect modules 86 for appropriate connection to the battery and the ignition coil through the switch 96. The switch 96, schematically shown in FIG. 6, is of conventional construction permitting the user to select on, off, and start positions as well as having the capability of isolating the magnetos and/or ignition devices from the circuit for testing purposes.

The second Hall effect module 88 is similarly equipped with conductors 92 and 94 for appropriate connection to the battery and ignition coil through the switch 96. The module 86 may be considered as the starting module or starting circuit while the module 88 is the running module. During the starting phase, it is necessary to retard the engine spark timing and to advance the timing once the engine becomes self-sustaining. The second Hall effect module is therefore positioned adjacent the rotor collar at a point where the timing of the spark is retarded to approximately top dead center (TDC) in order to prevent propeller "kickback" and its attendant hazards. Positioning and retention of the Hall effect modules may be achieved by any suitable technique such as clamping screws, etc. Each of these modules constitutes the means for effecting coil discharge and thus spark generation in the phase of engine operation to which it is directed. By this technique, applicant's invention makes a major step forward in the state of the art since it automatically eliminates the need for an impulse coupler to mechanically retard the spark during the starting phase. Elimination of the impulse coupler not only reduces the cost of the overall ignition device, but enhances system reliability as well since impulse couplers are notoriously prone to mechanical malfunction.

Another advantage of applicant's invention arising out of the elimination of the impulse coupler results in the reduction in the overall size (depth) of the ignition device since the elimination of the coupler permits the use of a shorter drive shaft with drive gear 34 attachment thereto. Moreover, the shock absorbing drive means normally associated with magneto drives is also eliminated since there is no pulse pause resistance generated by the drive shaft as it rotates in its bearings. The rotating magnets in a conventional magneto introduce such pulse pause to the drive system with each successive rotation thus necessitating the interpositioning of shock absorbing means somewhere in the magneto drive train.

While it is contemplated that applicant's device may be used to replace both magnetos on an aircraft engine, it is also within applicant's contemplation that the ignition system can include one breakerless component and one conventional magneto. Initial testing has indicated that numerous advantages are achieved by the breakerless unit over conventional magneto ignition systems, among which are the following.

The breakerless system is battery operated and thus generates significantly higher voltage and "healthier" spark at the plugs delivering up to 65,000 volts as opposed to a magneto system which delivers approximately 20,000 volts.

The breakerless system requires no special shielded ignition harness to prevent ignition noise in the aircraft communication and navigation systems.

A conventional magneto for a four cylinder engine including an impulse coupler weighs approximately 6 ½ pounds, the breakerless system of applicant's invention weighs approximately 3 ½ pounds, thus effecting a considerable weight advantage.

The breakerless system eliminates totally the need for both breaker points or a condenser and pre-set timing on each of the two timing circuits remains constant. The breakerless system requires no lubrication and no external computer system, thus making it a self-contained unit with the exception of the ignition coil which is externally mounted.

Applicant's invention permits the user to employ many components which are taken from automotive ignition systems and are therefore available on an over the counter basis at automotive equipment supply facilities. For example, the rotor arm and the dust cover together with the distributor cap are all conventional automotive components. Moreover, the use of applicant's unique system permits the use of automotive ignition wire conductors as opposed to the complex ignition leads normally employed with a magneto which are designed to reduce spark interference with the aircraft navigation and communication systems. Accordingly, applicant's invention not only enhances the quality of the igniting means, but achieves that improved quality at considerable reduction in cost, weight and maintenance.

The detailed description of applicant's invention is for illustration purposes only and is by way of example, not by way of limitation.

I claim:

1. A breakerless battery powered ignition system for aircraft engines including at least one ignition unit, each unit including a drive housing configured to be mounted on at least one of the magneto drive pads of a conventional internal combustion aircraft piston engine, drive means interconnecting said engine and said ignition unit to rotate an electrical energy distributor ratio of 2:1 including rotatable magnet means within said unit to deliver electrical energy to a plurality of distribution terminals on said unit, first and second Hall effect and amplifier modules within said unit adjacent said rotating magnet means and controlling the delivery of electrical energy to said distribution terminals in preselected sequence, each of said Hall effect modules controlling a separate timing circuit, said first module controlling the ignition timing circuit during the engine starting phase and said second module controlling the ignition timing circuit during the running phase of said engine, switch means for selectively activating each of said Hall effect modules and conductor means for delivery of said electrical energy controlled by said system to the spark plugs of said engine in predetermined sequence.

2. The ignition system defined by claim 1 wherein said drive means includes a pair of interconnected drive gears within said drive housing and having a ratio of 3:1.

3. The invention defined by claim 1 wherein one of said Hall effect modules is fixedly secured to the cover and the other of said Hall effect modules is adjustably secured to said cover.

4. The device of claim 3 wherein said fixed Hall effect module is positioned to trigger said ignition timing circuit approximately 25° before top dead center.

5. The invention defined by claim 1 wherein said first Hall effect module is positioned to trigger said ignition timing circuit at about piston top dead center position when said unit is mounted on an internal combustion piston engine.

* * * * *